United States Patent [19]

Feng

[11] Patent Number: 4,800,834

[45] Date of Patent: Jan. 31, 1989

[54] TELESCOPIC ROD MEANS WITH ROLLING DISPLAY SHEET

[76] Inventor: Ou-Yang Feng, No. 18, Lane 25, Hang-Chou S. Rd., Sec. 2, Taipei, Taiwan

[21] Appl. No.: 81,685

[22] Filed: Aug. 5, 1987

[51] Int. Cl.[4] ..... G09F 17/00

[52] U.S. Cl. ..... 116/173; 116/174; 116/175; 116/28 R; 40/607

[58] Field of Search ..... 116/63 R, 63 P, 28 R, 116/DIG. 26, 173, 174, 175; 40/601, 603, 604, 606, 608, 607, 610; 52/648, 40, 111, 720, 726, 735, 738, 740, 739, 113, 114, 117, 118; 285/298, 302, 303; 138/120, 121, 122; 160/372, 376

[56] References Cited

U.S. PATENT DOCUMENTS

| | | | |
|---|---|---|---|
| 1,288,060 | 12/1918 | Duc | 116/173 |
| 2,324,616 | 7/1943 | Dalton | 116/173 |
| 2,533,459 | 12/1950 | Holliday | 116/173 |
| 2,538,885 | 1/1951 | Schumann, Jr. | 116/173 |
| 3,286,682 | 11/1966 | Cook et al. | 116/173 |
| 3,416,477 | 12/1968 | Gunderson | 116/173 |
| 3,417,732 | 12/1968 | Platt, Jr. | 116/173 |
| 3,587,520 | 6/1971 | Miller | 116/173 |
| 3,602,188 | 8/1971 | Penaflor | 116/173 X |
| 3,675,616 | 7/1972 | McInnis | 116/173 |
| 4,662,305 | 5/1987 | Cline | 116/173 |

*Primary Examiner*—William M. Shoop, Jr.
*Assistant Examiner*—Paul Ip

[57] ABSTRACT

A telescopic rod includes a hollow-pipe handle having a longitudinal slit, an alignment coupler slidably moving along the longitudinal slit of the handle and operatively retained on the top of the handle adapted for aligning a display sheet with the slit, a reel pole prewound with a display sheet selected form a flat cloth or other flexible display sheets and operatively retained on the coupler for outwardly extending the pole and the display sheet for display purpose, and operatively retracted into the handle for reeling up the display sheet on the pole for its convenient handling and storage.

2 Claims, 3 Drawing Sheets

32
41
3
33
10
201
34
4
12
21
2
111
22
24
31
23
1
11
14

32
10
3
4
12
2
1
34
201
2
22
21
20
24
25
23
I
I
31
13
14

25
3
1
22
22
2
24
31
11
21

TELESCOPIC ROD MEANS WITH ROLLING DISPLAY SHEET

BACKGROUND OF THE INVENTION

Sherman E. Metzger disclosed a coupling in his U.S. Pat. No. 1,033,187 adapted for securely and quickly coupling the ends of hose or pipe sections together. Such a coupling can be inferentially applied to be a telescopic rod for serving as a flagpole, if by extending the length of the reduced end (9) of the male coupling (8) and the longitudinally groove portions (12, 13). However, it may still have the defects, such as:

1. Once retracting the male pipe (8) to couple the female one (5), the coupling will not be rotatable since the spring plate (17) is locked into recess (15) and is thus not suitable for serving as a flagpole, requiring the rotational winding of its flag cloth on the pole.

2. Whenever coupling the male one (8) with the female one (5), the spring plate (17) should be carefully aligned with the longitudinal groove (12), thereby causing inconvenience for an operator.

The present inventor has found the defects of a conventional coupling for pipes and invented the present telescopic rod means which is rotationable as retracted, and can be aligned automatically for quicker retracting operation.

SUMMARY OF THE INVENTION

The object of the present invention is to provide a telescopic rod means including: a hollow-pipe handle having a longitudinal slit formed thereon, an alignment coupler slidably moving along the longitudinal slit of the handle and operatively retained on a top portion of the handle adapted for aligning a display sheet with the longitudinal slit, a reel pole prewound with a display sheet selected from a flag cloth or other flexible display articles, which is operatively retained on the coupler for extending the pole and the display sheet upwardly and outwardly beyond the handle for display purpose; and operatively retracted into the handle for reeling up the display sheet on the pole for its convenient handling and storage.

DETAILED DESCRIPTION

Figures 1, 2, 3:
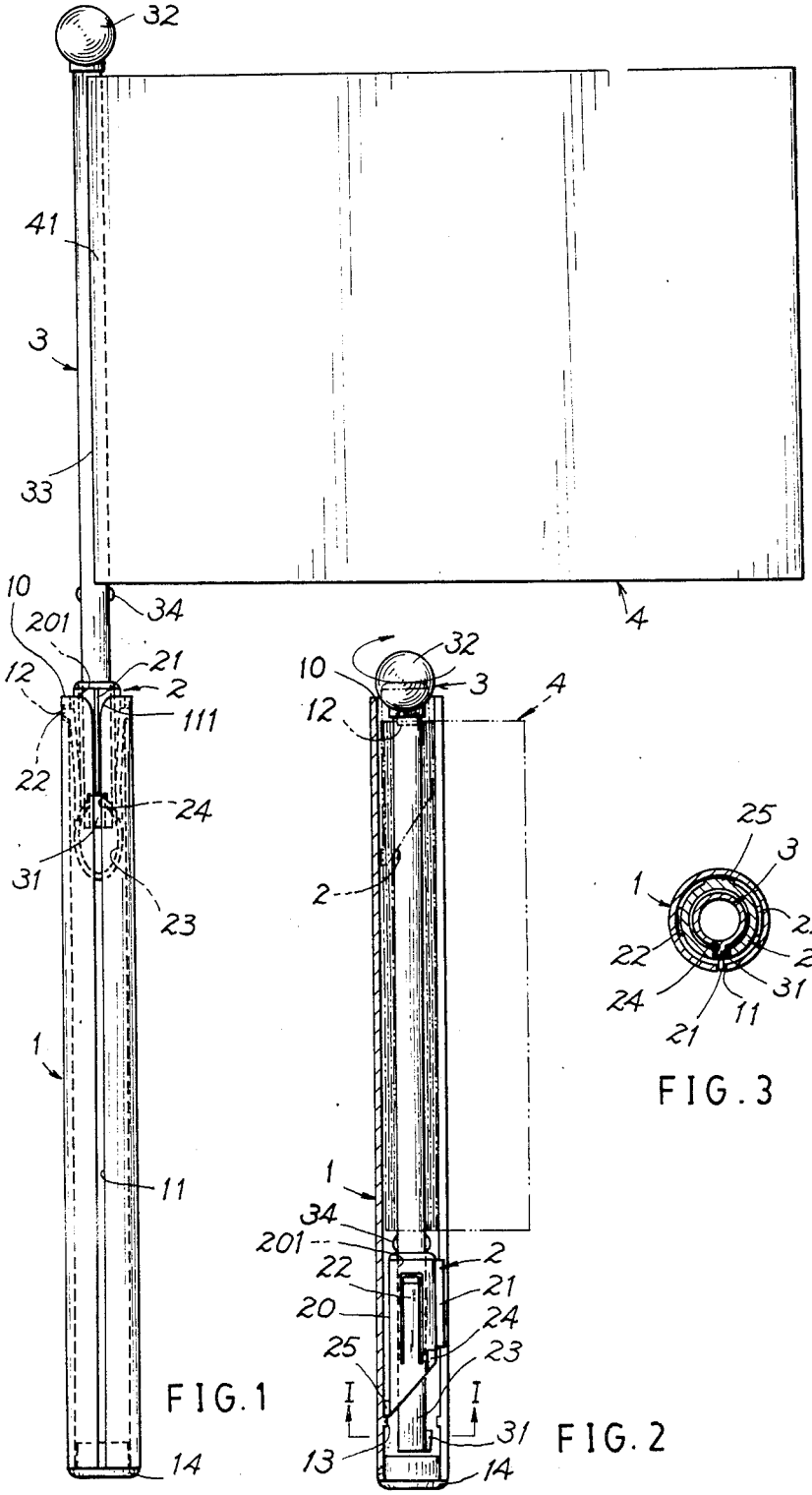
FIG. 1 is an illustration showing the present invention as extended.
FIG. 2 is an illustration of the present invention when retracted.
FIG. 3 is a sectional drawing of the present invention as viewd from II direction of FIG. 2.

As shown in FIGS. 1–4 , the present invention comprises: a hollow-pipe handle 1, an alignment coupler 2 slidably moving in the handle 1, a reel pole 3 as jacketed in the coupler 2 operatively reciprocating and rotating in the handle 1, and a display sheet 4 having its one side edge 41 longitudinally fixed on the pole 3.

The hollow-pole handle 1 is formed with a longitudinal slit 11 as cut from its top opening 10 having an expansion trumpet port 111 near the opening 10, a pair of side windows 12 symmetrically disposed on both sides of the upper portion of the handle, an annular extension 13 formed on its lower portion inside the handle, and a bottom cap 14 sealing a bottom hole of the handle 1.

The alignment coupler 2 is a generally cylindrical-shaped sleeve 20 having an inner cylindrical hole 201 adapted for reciprocating the pole 3 and includes:

a longitudinal extension 21 formed on the sleeve 20 slidably engaging with longitudinal slit 11 formed on the handle 1, a pair of spring hook plates 22 secured to the lower portion of the sleeve 20 and slightly protruding outwardly for operatively engaging the windows 12 of the handle 1, an inclined-surface portion 23 formed on the lower portion of the sleeve 20, a recess 24, formed on the sleeve 20 aligned with the extension 21 as positioned above the inclined-surface portion 23, and an arcuated extension 25 formed on the lower perimeter of the sleeve 20 to be limited against the annular extension 13 of the handle 1.

The reel pole 3 includes: a key extension 31 formed on the lower end of the pole 3 engageable with the recess 24 of the coupler 2, a top knob 32 formed on its top end, a lengthy aperture 33 longitudinally formed on the pole 3 for fixing the side edge 41 of the display sheet 4, and a pin 34 transversely fixed under the aperture 33 operatively pushing the coupler 2 downwardly when retracting the pole 3 into the handle 1.

The display sheet 4 is selected from: a flag cloth, a flexible cloth or paper having suitable toughness for display, ornamental or advertising purposes. The height of the sheet 4 should be small than the length of the slit 11 of the handle.

Figure 4:
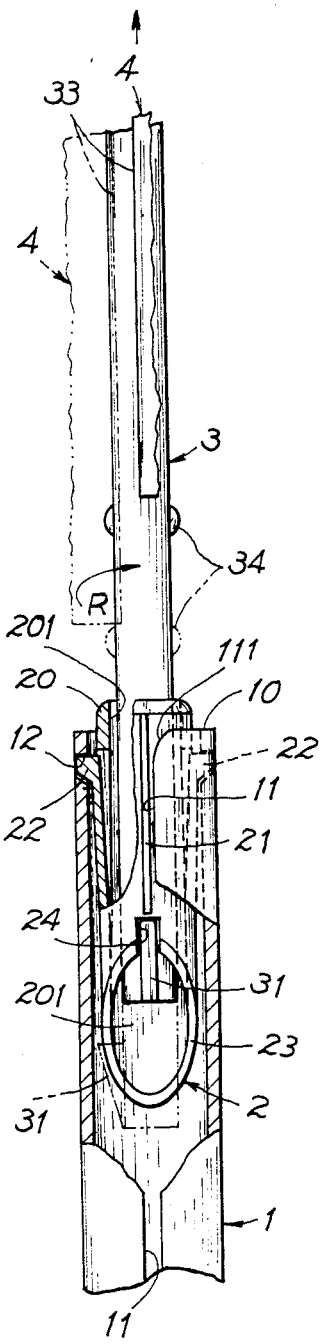
FIG. 4 shows an operating principle of the present invention when pulling the pole outwardly.
Figure 6:
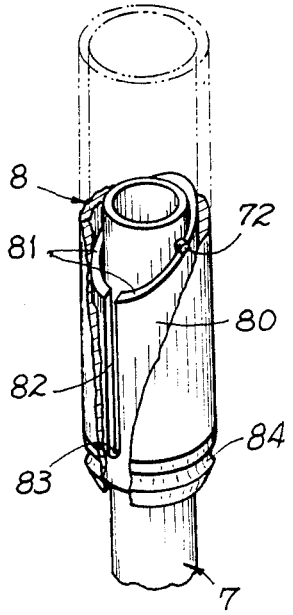
FIG. 6 shows the coupling of a third pole section with a second pole section of the present invention as shown in FIG. 5.
Figure 8:
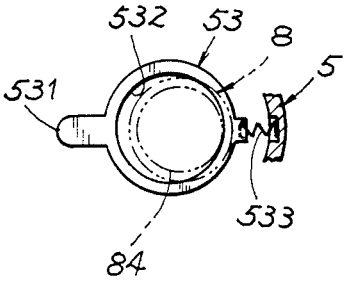
FIG. 8 is an illustration showing a pole lock of the present invention.
Figure 9:
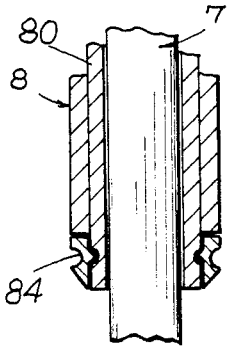
FIG. 9 shows a lower groove of a third pole of the present invention.

When it is intended to extend the pole 3 originally retracted into the handle 1 as prewound with a display sheet 4, the pole knob 32 is pulled outwardly and the key extension 31 when meeting the inclined-surface portion 23 of the coupler 2 will be slippingly guided along the slope of the inclined-surface portion 23 to be finally engaged with the recess 24 of the coupler 2 to thereby rotate the pole 3 in direction R as shown in FIG. 4 to rotate the lengthy aperture 33 to be aligned with the longitudinal slit 11 of the handle 1. Since the coupler 2 is also pulled to have its spring hook plates 22 engaged with the windows 12 of the handle to thereby be retained on the top portion of the handle 1, the pole 3 having its key extension 31 engaged with the recess 24 will also be retained as an extended position as shown in FIG. 1, whereby the display sheet 4 will be automatically reeled off by its own toughness to show a flag cloth or any other display figures.

If for retracting the extended pole 3 with display sheet 4 into the handle 1, there is no need to further align the sheet 4 with the slit 12 because the aperture 33 is already aligned with the slit 12 and upon the depression of the knob 32 the pole with sheet will be retracted into the handle 1, with the sheet 4 passing through the slit 12 without any obstruction. The coupler 2 is also retracted into handle as pushed by pin 34. As shown in FIG. 2, when the arcuated extension 25 of the coupler 2 is obstructed against the annular extension 13 inside the handle 1, the coupler 2 is limited there and the further depression of pole 3 will protrude the key extension 31 toward the cap 14 so that the knob 32 can be rotated to wind the sheet 4 on the pole 3 to conceal the sheet 4 into the handle 1 for convenient handling and storage.

Another preferred embodiment of the present invention is shown in FIGS. 5–8, which comprises: a hollow-pipe handle 5 having a longitudinal slit 51 formed on the handle as cut from the top opening 50, a bottom portion 52 and a pole lock 53; a first pole section 6 having a lower end 61 mounted on the bottom 52, an upper extension 62 mounted on its top end and a helical spring 63 jacketed inside the first pole section 6; a second pole section 7 jacketed outside the first section 6 having a lower hook 71 slidably engaged with a longitudinal groove 60 and limited by the extension 62 and an upper key 72 formed on the upper end of the second section 7; a third pole section 8 jacketed outside the second section 7 having an inner cylinder 80 embedded inside the third pole which is formed with an inclined-surface portion 81 on its upper end and formed with a longitudinal slit 82 under the inclined-surface portion 81 to be terminated at the lower edge 83 of the inner cylinder 80 of the third section 8, and a lower annular groove 84 formed on a ring rotatably formed on its lower perimeter and a display sheet 4 selected from a flag cloth or other display articles having a side edge 41 longitudinally fixed on a lengthy aperture 86 on the third pole section B. The spring 63 resiliently tensions the third section 8 upwardly to extend the display sheet 4. The slit 82 is always aligned with the lengthy aperture 86 and with the slit 51 formed on the handle 5 so that once pulling the third section 8 upwardly by holding the top knob 85 the key 72 is slippingly guided by the slope of the inclined-surface portion 81 to move along the slit 82 to be finally limited by the edge 83 of the third section 8, resulting in extending the third section 8 with extended sheet 4 for display purpose. By depressing the third section 8 downwardly, the third section 8 is downwardly moved along the slit 82 to correspond the lengthy aperture 86 of display sheet 4 with the lower slit 51 for quicker retraction of all pole sections, without requiring inconvenient alignment of sheet 4 with the handle 5.

Figures 5, 7:
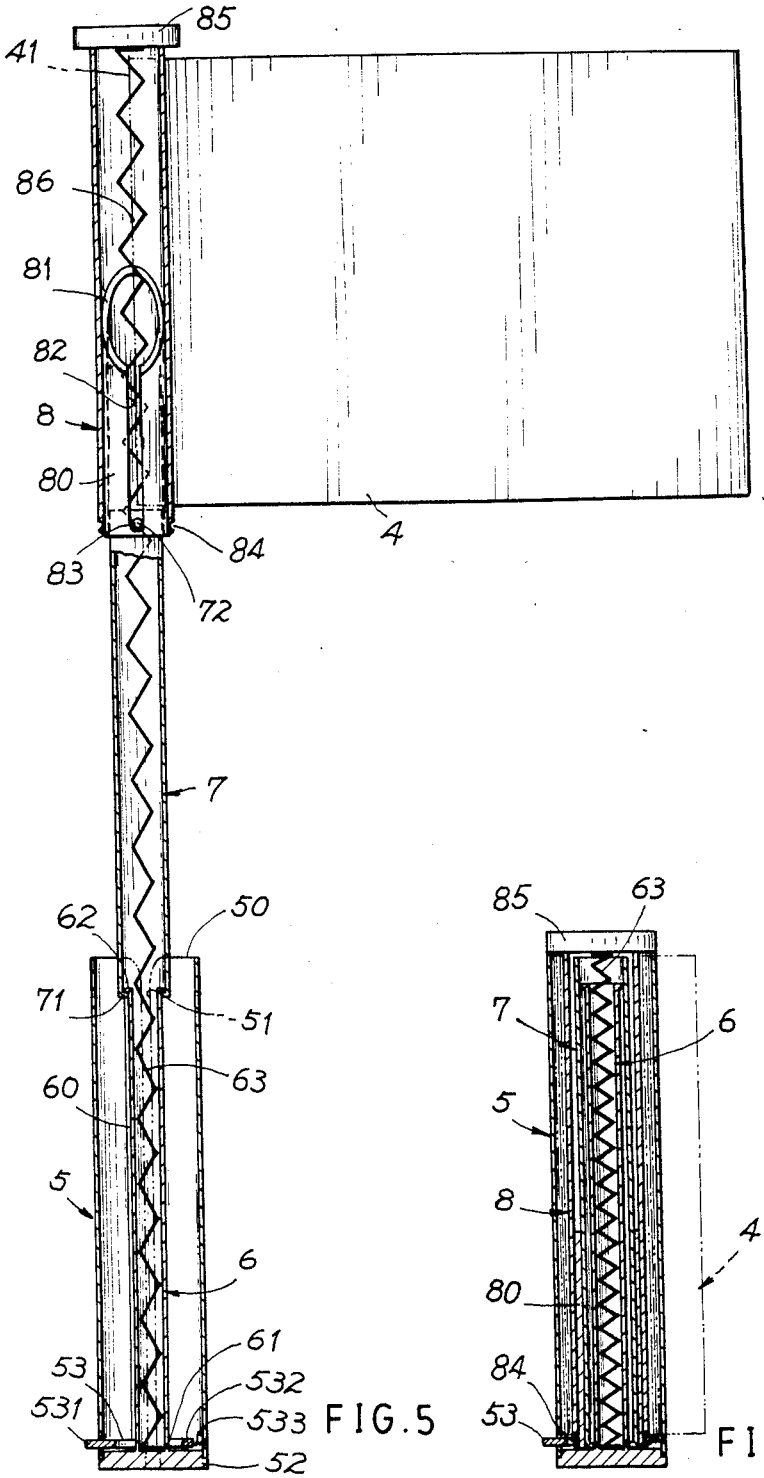
FIG. 5 shows another preferred embodiment of the present invention.
FIG. 7 shows the retracted elements of the present invention as shown in FIG. 5.

The number of the pole sections of this invention is not limited to be three sections as shown in FIG. 5. The plural sections can be modified in accordance with this invention.

The pole lock 53 includes a button 531 protruding outwardly the handle 1, a collar 532 larger than the diameter of the third pole section 8 and a tensioning spring 533 resiliently retaining the collar 532 to engage with the lower annular groove 84 for locking the pole section 8 when retracted into the handle 5.

During the retraction of the plural poles 8, 7, 6, they are not rotational to help alignment of the sheet 4 with the handle slit 51.

I claim:

1. A telescopic rod means comprising:

a hollow-pipe handle having a longitudinal slit formed thereon as cut from its top opening, a pair of side windows symmetrically disposed on both sides of its upper portion, an annular extension formed on its lower portion inside the handle, and a bottom cap sealing a bottom hole of said handle;

an alignment coupler being a generally cylindrical-shaped sleeve having an inner cylindrical hole therein, having a longitudinal extension formed on said sleeve slidably engaging with said longitudinal slit formed on said handle, a pair of spring hook plates secured to said sleeve and slightly protruding outwardly for operatively engaging said windows of said handle, an inclined-surface portion formed on the lower portion of said sleeve, a recess formed above said inclined-surface portion and aligned with said longitudinal extension of said sleeve, and an arcuated extension formed on the lower perimeter of said sleeve as operatively limited against said annular extension of said handle; and a reel pole including a key extension formed on the lower end of said pole engageable with said recess of said coupler, a top knob formed on its top end, a lengthy aperture longitudinally formed on said pole for fixing a side edge of a display sheet selected from a flexible flag cloth and flexible clothes or papers having suitable toughness, and a pin transversely fixed under said lengthy aperture operatively pushing said coupler downwardly when retracting said pole into said handle;

said key extension of said pole operatively engaged with said recess of said coupler as engaged with said windows of said handle to automatically align said lengthy aperture of said display sheet with said longitudinal slit on said handle.

2. A telescopic rod means comprising:

a plural pole sections telescopically mounted in a hollow-pipe handle and resiliently extended by a helical spring jacketed inside said pole sections;

an upper pole section fixed with a display sheet having an inner cylinder embedded inside said pole section formed with an inclined-surface portion on the upper end of said pole section and formed with a longitudinal slit under said inclined-surface portion;

a lower pole section mounted in said handle as jacketed inside said upper pole section having a key extension formed on its upper end slippingly guided along said inclined-surface portion of said upper pole section to move along said longitudinal slit of said upper pole section to align said display sheet with a lower longitudinal slit formed on said handle adapted for passing said sheet into said lower slit when retracting said upper pole section into said handle.

* * * * *